US007261047B2

(12) United States Patent
Ljungdahl

(10) Patent No.: US 7,261,047 B2
(45) Date of Patent: Aug. 28, 2007

(54) CONTROL OF CYCLONE BURNER

(75) Inventor: Boo Ljungdahl, Nyköping (SE)

(73) Assignee: TPS Termiska Processer AB, Nyköping (SE)

( * ) Notice: Subject to any disclaimer, the term of this patent is extended or adjusted under 35 U.S.C. 154(b) by 0 days.

(21) Appl. No.: 10/515,024

(22) PCT Filed: May 21, 2003

(86) PCT No.: PCT/SE03/00817

§ 371 (c)(1),
(2), (4) Date: Jan. 19, 2005

(87) PCT Pub. No.: WO03/100320

PCT Pub. Date: Dec. 4, 2003

(65) Prior Publication Data

US 2005/0132942 A1 Jun. 23, 2005

(30) Foreign Application Priority Data

May 29, 2002 (SE) ..... 0201621

(51) Int. Cl.
*F23D 1/00* (2006.01)

(52) U.S. Cl. ..... 110/347; 110/342; 110/266

(58) Field of Classification Search ..... 110/210, 110/211, 212, 213, 214, 243, 244, 266, 348, 110/342, 344, 345; 431/62, 65, 12
See application file for complete search history

(56) References Cited

U.S. PATENT DOCUMENTS

| | | | | |
|---|---|---|---|---|
| 4,033,505 | A | 7/1977 | Lutes et al. | |
| 4,585,161 | A * | 4/1986 | Kusama et al. | 236/15 BD |
| 4,765,258 | A * | 8/1988 | Zauderer | 110/347 |
| 5,029,557 | A | 7/1991 | Korenberg | |
| 6,027,330 | A * | 2/2000 | Lifshits | 431/8 |
| 6,202,578 | B1 | 3/2001 | Ruottu et al. | |

FOREIGN PATENT DOCUMENTS

| | | |
|---|---|---|
| DE | 36 03 788 | 8/1987 |

* cited by examiner

*Primary Examiner*—Kenneth Rinehart
(74) *Attorney, Agent, or Firm*—Buchanan Ingersoll & Rooney PC

(57) ABSTRACT

A method of operating a combustion process in a cyclone burner, after start-up thereof, is provided. A fuel and a combustion gas is fed into a combustion chamber of the cyclone burner. The velocity of the combustion gas is kept between a lower and an upper limiting gas velocity. The stoichiometric condition (sub- or over-stoichiometric) is maintained by controlling the amount of fed oxygen to the amount of fed fuel. A shift is made to the other stoichiometric condition while preventing the combustion gas from obtaining a velocity outside the range defined by the lower and upper limiting gas velocity.

25 Claims, 6 Drawing Sheets

CONTROL OF CYCLONE BURNER

TECHNICAL FIELD OF THE INVENTION

The present invention relates to a method of operating a combustion process in a non-slagging cyclone burner, after start up thereof.

BACKGROUND ART

A pre-heat or furnace burner of the cyclone type can be described as an "adiabatic" circular burner having a combustion chamber into which combustion gas, such as air, is introduced tangentially to form a swirling flow. Fuel particles are introduced into the gas flow and by the centrifugal force acting on them they will be transported along the chamber wall. The fuel in a cyclone burner preferably comprises ground particles, but in comparison to a free standing solid fuel burner, the demand for fine material is much lower.

In many applications the temperature inside the cyclone burner is so high that the fuel ash melts and forms a slag, which must be continually withdrawn from the burner. This is typically the case when it is used to fire coal. In other applications, typically wood combustion, the temperature is controlled so that melted ash—stickiness—is avoided.

In most applications, the cyclone burner is refractory lined, preventing corrosion and minimizing heat losses. In combination with a high thermal density this leads to an approximately adiabatic temperature within the burner.

In many applications it is desirable to maintain the temperature within a certain temperature range in order to obtain a satisfactory carbon burnout while avoiding the drawbacks, such as the above mentioned stickiness, at high temperatures. The highest temperature is reached just below stoichiometric condition, i.e. the condition when the oxygen of the combustion gas or air added equals the amount for completely combusting the fuel. If less oxygen is added, i.e. sub-stoichiometric condition, the temperature will be lower, and the same applies if more oxygen is added, i.e. over-stoichiometric condition, since the excess oxygen will serve as a cooling medium. This is illustrated in appended FIG. 1.

The turndown ratio, i.e. the maximum to minimum operable fuel load ratio for a given cyclone burner, is limited by the demand of particle circulation and by extensive particle carryover (shortcutting). In other words, the gas flow or the velocity of the gas should be above a lower limit in order to entrain the fuel particles whilst avoiding disentraining them due to gravitational and frictional forces, and should also be below an upper limit in order to avoid particles exiting from the combustion chamber before being fully combusted.

The slagging cyclone burner is the most common application. They are operated in an over-stoichiometric condition, the main reason being to avoid a corrosive environment at reducing conditions when firing coals. Typically a turndown ratio of about 2:1 is possible. A slagging cyclone burner is used for complete melting of ash particles, which are mainly withdrawn as slag. In contrast, a non-slagging cyclone burner is operated at such conditions that severe slagging will not occur inside the burner. The ash is thereby mainly withdrawn as solid fly ash particles. Non-slagging cyclone burners can be operated under either sub- or over-stoichiometric conditions, although sub-stoichiometric is the most common. Typically, a turndown ratio of 4:1 is possible. Operation under sub-stoichiometric conditions is preferred because the burner can be built more compactly. The specific volume flow of gases through the cyclone burner ($m^3/kg_{fuel}$) can be regarded as approximately proportional to the stoichiometric ratio and thus a higher thermal load is possible under a sub-stoichiometric condition.

The prior art provides little controllability as regards the combustion process of cyclone burners, and it is difficult to achieve a larger turndown ratio than 4:1 while operating in the desired temperature range. The main reasons for this are because the retention time of the fuel particles inside the combustion chamber is limited at high gas flow or because the circulation in the combustion chamber becomes insufficient at low gas flow. One possible solution for obtaining a larger turndown ratio would be to provide a longer burner. However, such a construction would be costly, bulky and demand a lot of space. Furthermore, a longer burner would provide considerable layout difficulty if it was to replace a conventional existing burner.

SUMMARY OF THE INVENTION

An objective of the present invention is to provide a method that enables enhanced controllability and adjustability of a compact non-slagging cyclone burner.

Another objective of the present invention is to provide a method that increases the possible turndown ratio for a given cyclone burner.

These and other objectives, which will become apparent from the following description, are achieved by means of a method as defined in the accompanied claims.

The invention is based on the insight that by shifting between sub-stoichiometric and over-stoichiometric conditions in one and the same zone of a combustion chamber of a non-slagging cyclone burner it is possible to obtain increased adjustability and larger turndown ratio than in the prior art.

Commonly, it is desirable to keep the temperature in the combustion chamber of the cyclone burner within a limited temperature range. The lower the temperature in the combustion chamber, the slower combustion rate of char particles (remainder after pyrolysis) obtained, and thereby also char accumulation within the burner resulting in possibly a lower output from the cyclone burner. Suitably, the lower limit of the temperature range is at least 700° C., and preferably 900° C. However, under certain circumstances, such as for a specific fuel material the limit may be even lower, such as 600° C. The upper limit of the temperature range depends inter alia on melting and sticking of the burned fuel. Suitably, the upper limit of the temperature range is at most 1300° C., and preferably 1100° C. However, under certain circumstances, such as for a specific fuel material the limit may be even higher, such as 1400° C. This means that the amount of combustion gas should be controlled in relation to the amount of fuel present in the combustion chamber in order to keep the temperature within a desired range. In other words according to at least one embodiment of the invention, one of the two stoichiometric conditions: sub-stoichiometric condition and over-stoichiometric condition, is maintained by controlling the amount of fed oxygen to the amount of fed fuel.

Thus, if the load, i.e. the amount of fuel fed into the combustion chamber is decreased, then the combustion gas flow may also be decreased in order to maintain the same stoichiometric condition. The lowest possible gas flow or gas velocity for keeping the fuel particles circulating, will therefore normally set the lower limit of the load. We have realized that if the cyclone burner is operated under sub-stoichiometric conditions, it is possible to decrease the load not only to the load limit at which the gas flow would be on the border of being insufficient for the circulating motion, but also to an even lower load by shifting to over-stoichiometric condition at said load limit. This means that excess combustion gas is suddenly provided allowing the load to be reduced considerably. Both sub- and over-stoichiometric conditions may keep the temperature within the desirable temperature range.

As mentioned previously, the operation of a cyclone burner is limited by a) a minimum or lower limiting gas velocity to ensure that the fuel particles are circulated and b) a maximum or upper limiting gas velocity set by the limit where carryover of unburned particles becomes too high. For a given cyclone furnace and a given fuel, it is possible to choose either to operate in an over-stoichiometric condition with a relatively low maximum load, or to operate in a sub-stoichiometric condition with a relatively high minimum load. By combining the operational modes the turndown ratio can be increased.

According to one aspect of the invention, a method of operating a combustion process in a cyclone burner is provided. According to the method fuel is fed into a cylindrically shaped combustion chamber of the cyclone burner and an oxygen-containing combustion gas, such as air, is introduced with a tangential velocity component into said combustion chamber so as to provide at least partial circulation of the fuel along the chamber wall, for the fuel to be gasified or combusted. A lower limiting gas velocity and an upper limiting gas velocity is defined for said combustion gas. The velocity of the combustion gas is held between said limiting gas velocities. Either a sub-stoichiometric condition or an over-stoichiometric condition is maintained in the combustion chamber by controlling the amount of fed oxygen to the amount of fed fuel. The method further comprises shifting to the other one of said two stoichiometric conditions while preventing the combustion gas from obtaining a velocity outside the range defined by the lower limiting gas velocity and the upper limiting gas velocity.

This means that regardless of the shifting direction, i.e. from sub- to over-stoichiometric condition or vice versa, the velocity of the combustion gas will be no lower than the lower limiting gas velocity and no higher than the upper limiting gas velocity. This applies to both before and after the act of shifting from one stoichiometric condition to the other, and also during the actual shifting.

For a given temperature in the combustion chamber, said temperature defines together with said limiting gas velocities, a possible transition region, i.e. a range of fuel loads for which transition or shifting from one of the two stoichiometric conditions to the other one is possible in accordance with the teachings of at least one embodiment of the present invention. The minimum fuel load and the maximum fuel load for said range is dependent on the temperature.

It has been found that by mixing recirculated flue gas with the oxygen-containing combustion gas prior to feeding the combustion gas into the combustion chamber, the possible transition region is expanded. In other words, for each given temperature the addition of recirculated flue gas to the oxygen-containing combustion gas will result in a lower minimum fuel load than what would be the case without the addition of the recirculated flue gas.

The addition of recirculated flue gas affects both the sub- and over stoichiometric conditions. The turndown ratio under sub-stoichiometric conditions can be further extended if recirculated flue gases are mixed with the combustion gas prior to providing the combustion gas to the combustion chamber. The effect is twofold. Firstly, the recirculated flue gas increases the gas flow without increasing the heat released from the fuel. The stoichiometric ratio is dependent on the amount of oxygen containing-gas. Since some of this oxygen-containing gas may be replaced by essentially non-oxygen-containing flue gas (or having very small amount of oxygen) a sub-stoichiometric condition will be obtainable for an even lower load than in the case when no flue gas is recirculated, without compromising the circulating effect. Thus, the minimum limit of gas flow is reached at a lower load. Secondly, the recirculated flue gas serves as ballast. Additional oxygen-containing gas, such as combustion air, is thus demanded in order to release more heat from the fuel thereby maintaining the temperature, and, in other words, the stoichiometric ratio is displaced somewhat closer to 1. This means that the minimum limit is reached at a further lower load.

Under over-stoichiometric conditions the added flue gas will partly replace excess combustion air. The flue gas will work as a ballast, which means that one and the same amount of fuel will heat a larger mass, thereby enabling the use of less combustion air for cooling. In the case that the total gas flow remains the same, the benefit is that the oxygen concentration will decrease. Thus, less nitrogen oxide is formed.

The main effect of using recirculated flue gas is that the load span within which it is possible to operate under sub-stoichiometric conditions is increased.

As an alternative to recirculated flue gas, it would be possible to obtain a similar result, i.e. expanding the possible transition region, by mixing the combustion gas with any inert gas or a gas containing a lower percentage of oxygen.

While it is possible to vary the amount of combustion gas (such as air) in order to control the temperature in the combustion chamber, an alternative is to use recirculated flue gas (or inert gas or low oxygen-containing gas) for controlling the temperature in the combustion chamber. This is advantageous when it is desirable to maintain a predefined stoichiometric ratio, wherein the temperature is controlled by varying the amount of recirculated gas added to the combustion gas. The gas velocity is kept within predefined limits.

According to at least one embodiment of the invention the stoichiometric conditions are controlled without mixing any additional inert or recirculated flue gas with the combustion gas. In this case it is possible to maintain an essentially constant stoichiometric ratio between the oxygen and the fuel non-equal to 1, i.e. at one of the two states: sub-stoichiometric and over-stoichiometric, by controlling the amount of fed combustion gas depending on the amount of fed fuel. One essentially constant stoichiometric ratio is held before the act of shifting, and another ratio is held after the act of shifting from one stoichiometric condition to the other. Thus, if a relatively low load is present, i.e. a low amount of fuel is fed into the combustion chamber, an essentially constant over-stoichiometric ratio may be kept until the time of shifting to an essentially constant sub-stoichiometric ratio, said time of shifting being inter alia dependent on the size of the load. The term essentially constant stoichiometric ratio should be understood to allow such a variation of the stoichiometric ratio that provides a temperature within a certain desired temperature range. For instance, merely as an illustrative example, reference is made to FIG. 1, wherein for a temperature range of 1200° C.-1300° C. the (sub-) stoichiometric ratio should be around 0.4-0.45 and the (over-)stoichiometric ratio should be around 1.8-2. Thus, before and after the time of shifting but not during the time of shifting, when the load is increased or decreased, the amount of combustion gas is increased and decreased, respectively so as to keep the essentially constant stoichiometric ratio.

There are different options for controlling the amount of combustion gas fed into the combustion chamber. Limiting factors are the lower limiting gas velocity and the upper limiting gas velocity in the combustion chamber. The velocity of the combustion gas supplied from a combustion gas inlet will essentially be maintained as the gas enters and travels tangentially in the combustion chamber, i.e. the losses may be regarded as negligible. Having that in mind, a straight forward design is to provide a combustion gas inlet having a fixed cross-sectional area. By increasing or decreasing the amount of combustion gas entering the combustion chamber, the velocity of the gas is controlled. Alternatively, one may choose to supply the combustion gas so as to achieve a fixed velocity (at a level between the limiting gas velocities) and instead vary the opening area of the inlet. A large opening area is used when a large flow, i.e. a large amount of gas, is desired while a small opening area is used when a low amount of gas is desired. The desired amount of gas depends on the amount of fuel, as has been previously described. A further controlling alternative is to vary both the cross-sectional area of the inlet and the velocity of the provided combustion gas. Thus, in all three cases the gas flow, i.e. the volume per unit of time, is controllable.

A speedometer or a flowmeter may be provided in the gas supply piping for measuring and calculating the velocity of the combustion gas. Correspondingly, measuring devices, such as speedometer or flowmeter, may be provided for calculating the amount of fuel that is fed into the combustion chamber. Such measurements and calculations suitably serve as a basis for deciding on the time of shifting from one stoichiometric condition to the other one.

The described method of operating a combustion process in a cyclone burner is applicable for solid, liquid or gaseous fuel. It has been found particularly suitable for use with solid fuels. The solid fuel is aptly some kind of biofuel. The solid fuel may be in the form of particles, such as wood particles, preferably wood pellets, typically crushed wood pellets of a diameter up to 4 mm.

When using solid fuel particles, the lowest velocity for keeping at least a majority of the fuel particles circulating in the combustion chamber is set as said lower limiting gas velocity. The lower limiting gas velocity may also be set on the basis of the largest particle size of the fuel or on some other basis. For instance, some type of fuel particles that enter the combustion chamber will rapidly release their volatile matter, thereby decreasing the particle density. It may therefore be suitable in such cases to base the minimum or lower tangential gas velocity on the particle density obtained after devolatilisation. For wood particles this density is typically in the magnitude of 250 kg/m$^3$, about a quarter of the particle density before entering the combustion chamber.

For a "lying" cyclone burner, i.e. comprising a combustion chamber having a central axis of symmetry extending horizontally, the lower limiting gas velocity is suitably set so that certain criteria are met at the top of the combustion chamber.

For a cyclone burner combustion chamber having a horizontal central axis and circular cross-section in the vertical plane, the circulating gas flow within the combustion chamber can be regarded as non-expanding, and therefore the tangential periphery velocity equal to the gas inlet velocity.

Five forces act on the fuel particles, namely:

$$\text{Gravity } F_g = -m_p g$$

$$\text{Centrifugal } F_c = m_p \frac{V_{p,t}^2}{R}$$

$$\text{Friction } F_f = -\mu m_p a_N$$

$$\text{Tangential drag } F_{d,t} = C_d A_p \rho_g \frac{[V_{g,t} - V_{p,t}]^2}{2}$$

$$\text{Radial drag } F_{d,r} = C_d A_p \rho_g \frac{[V_{g,r} - V_{p,r}]^2}{2}$$

wherein $m_p$=mass of a particle g=gravitational constant

R=radius of the combustion chamber of the cyclone burner $V_{g,t}$=tangential gas velocity $V_{g,r}$=radial gas velocity $V_{p,t}$=tangential particle velocity $V_{p,r}$=radial particle velocity μ=friction factor $\alpha_N$=acceleration in normal direction $C_d$=drag coefficient $A_p$=cross-sectional area of a fuel particle $\rho_g$=density of the combustion gas The lower limiting gas velocity is suitably set by the situation where a particle at the highest position (at the top) is just prevented from falling down. This is the case when the gravity and radial drag forces balance the centrifugal force, resulting in zero friction. The limiting tangential particle velocity becomes:

$$V_{p,t} = \sqrt{R\left[g + C_d \frac{A_p}{m_p} \rho_g \frac{(V_{g,r} - V_{p,r})^2}{2}\right]} = \sqrt{R\left[g + \frac{3}{4} \frac{C_d}{d_p} \frac{\rho_g}{\rho_p} (V_{g,r} - V_{p,r})^2\right]}$$

The radial drag can be assumed to be negligible, and the limiting tangential particle velocity ($V_{p,t}$) is expressed as:

$$V_{p,t} = \sqrt{gR}$$

However, the tangential gas velocity inside the combustion chamber must be greater than the limiting particle velocity. The lower limiting gas velocity can be found by solving the following differential equation, thus determining the gas velocity securing the desired particle velocity at the top of the cyclone burner.

$$F_{d,t} + F_f + F_g = m_p \frac{\delta V_{p,t}}{\delta t} = m_p V_{p,t} \frac{\delta V_{p,t}}{\delta S}$$

Thus:

$$C_d A_p \rho_g \frac{[V_{g,t} - V_{p,t}]^2}{2} - \mu m_p \left[g\cos(\varphi) + \frac{V_{p,t}^2}{R}\right] - m_p g \sin(\varphi) = m_p V_{p,t} \frac{\delta V_{p,t}}{\delta S}$$

Here ϕ is the angle to the vertical, i.e. 180° at the top of the combustion chamber, and S is the distance travelled by the particle along the periphery.

Solving for the tangential gas velocity $V_{g,t}$ giving the desired particle velocity at the top $V_{p,t}=\sqrt{gR}$, one finds that it ($V_{g,t}$) increases as the radius of the combustion chamber of the cyclone burner and the particle diameter increase.

In a "standing" cyclone burner, i.e. a combustion chamber having a central axis of symmetry extending vertically and a circular cross-section in the horizontal plane, the forces acting on the particle are similar as for the "laying" cyclone with the addition of a vertical drag force. However, for simplicity, both the radial and vertical forces are considered as negligible. By assuming so, the tangential lower limiting gas velocity $V_{g,t}$ is calculated by solving the following equation (which will be further discussed in connection with accompanying FIG. 11):

$$V_{g,t} = \sqrt{gR\frac{\tan(\alpha)-\mu}{\mu\tan(\alpha)+1}} + \sqrt{\frac{4}{3}d_p\frac{\rho_p}{\rho_g}\frac{\mu}{Cd}\left[g\cos(\alpha)+g\frac{\tan(\alpha)-\mu}{\mu\tan(\alpha)+1}\sin(\alpha)\right]}$$

whereas $V_{g,t}$=tangential gas velocity g=gravitational constant

R=radius of the combustion chamber of the cyclone burner $\alpha$=the angle to the horizontal $\mu$=friction factor $d_p$=diameter of a fuel particle $\rho_p$=density of a fuel particle $\rho_g$=density of the combustion gas $C_d$=drag coefficient Alternatively, the lower limiting gas velocity may be determined empirically, i.e. by doing tests for a specific cyclone burner fired with a specific fuel. The method according to the present invention is applicable regardless of how the lower limiting gas velocity is determined.

The upper limiting gas velocity is suitably set at the highest velocity allowable for minimizing the amount of unburned fuel particles leaving the combustion chamber, said velocity being 20-50 m/s, preferably 25-40 m/s, such as in the order of 30 m/s. Another definition of the upper limiting gas velocity is 3-6 times the lower limiting gas velocity, typically 4 times.

One may expect that the separation efficiency, i.e. the tendency of the particles to travel along the wall of the combustion chamber, would increase infinitely as the tangential gas velocity is increased. However, in practice, re-entrainment of particles towards the central axis of the combustion chamber starts to be quite noticeable at a certain velocity due to the increased turbulence and vortex break down inside the cylindrical combustion chamber of the cyclone burner. Even though it is not straight forward to calculate the upper limiting gas velocity, it is understood by experience that a typical value is in the order of 30 m/s.

Another aspect limiting the possible upper gas velocity is the volume concentration of unburned fuel particles within the combustion chamber. It is the burn out time of the char (the remainder after devolatilization of the fuel) which is limiting. For a given temperature and stoichiometric ratio the amount of unburned char will within the combustion chamber of the cyclone burner be proportional to the load, and thereby also the tangential gas velocity. At a certain load the concentration of unburned fuel particles will become so high that re-entrainment will become quite noticeable. At over-stoichiometric conditions re-entrainment due to high tangential velocity is likely to be the limiting factor. At sub-stoichiometric operation re-entrainment due to choking by fuel particles is more likely.

The procedure for determining the upper limiting gas velocity may vary, e.g. by doing tests for a specific cyclone burner fired with a specific fuel. The method according to the present invention is applicable regardless of how the upper or lower limiting gas velocities are determined. They have the function of limiting values. For instance, according to at least one embodiment of the invention the act of shifting from one of the two stoichiometric conditions to the other one is performed just before the gas reaches one of said limiting gas velocities. According to at least one other embodiment of the invention said shifting to the other one of said two conditions is performed when the amount of fed fuel in the current stoichiometric condition would, for the other stoichiometric condition, require such an amount of combustion gas which corresponds to a velocity of gas flow that is within the interval of the limiting gas velocities.

As has been discussed above, the method according to the present invention provides a turndown ratio for cyclone burners, which is considerably greater than what has been possible to achieve in the prior art. Even though it is desirable to keep the temperature within a certain interval, both for sub- and over-stoichiometric conditions, said interval can actually be quite useful for further increasing the turndown ratio. Even though a temperature range between 900° C.-1100° C. may be preferred inside the cyclone burner, the range may acceptably be extended to 700° C.-1300° C. or even more. For instance, if one can allow a higher than normal temperature during sub-stoichiometric conditions, such as close to or about 1300° C., more oxygen is needed than usual in order to raise the temperature for the same amount of load. Since more oxygen-containing gas is allowed to be introduced to the cyclone burner relative to the amount of load, this means that the stoichiometric ratio is closer to 1, having the consequence that a lower minimum load is allowed, while still introducing enough gas to keep the particles circulating. Similarly, during over-stoichiometric conditions a relatively lower temperature may be allowable, i.e. more oxygen in relation to the load. This will also lead to a possible lower minimum load.

Even if it is possible to make use of varying temperatures, in many cases it may be desirable to maintain as even a temperature as possible. This may particularly apply to the actual time of shifting from sub- to over-stoichiometric ratio, and vice versa. Therefore, suitably, such a shift is performed swiftly so as to maintain the temperature level as even as possible. This may be achieved by means of a regulating system, e.g. comprising a computer, flowmeters for the fuel and the combustion gas and valves. The system may be programmed in the following manner. At over-stoichiometric operation a condition arises that a decreased amount of input combustion gas leads to an increase in temperature. A minimum allowed stochiometric ratio, above 1.0, is also set. At sub-stoichiometric conditions said condition is changed to where an increased amount of input combustion gas results in an increase in temperature, and the minimum stochiomatric ratio is replaced with an maximum, which is beneath 1.0. At the point of shifting to sub-stoichiometric operation, the regulating system is instantaneously given the new conditions, which means that the shift is obtained as fast as the valve(s) can change position. The reverse change of condition and limit value apply when going from sub-stoichiometric to over-stoichiometric operation.

From the above description it should now be clear that the method according to at least one embodiment of the present invention enables a change between gasification (i.e. sub-stoichiometric condition) at higher loads and combustion at lower loads. The invention allows this to be performed during operation of the cyclone burner, and not only during start-up thereof. Furthermore, as a difference to other prior art burners which may simultaneously be operated with sub-stoichiometric conditions in one zone and over-stoichiometric conditions in another zone, the present method makes it possible to utilize one and the same zone of a cyclone burner for shifting between the two different stoichiometric conditions.

It should also be clear that the inventive idea enables an increased turndown ratio (the relationship between the largest and smallest possible load to be fired in the cyclone burner). This may be useful e.g. when it is desirable to change the output to a furnace connected to the cyclone burner, typically in a district heating plant (up to 30-50 MW) or even in a domestic boiler (a couple of 100 kW). The temperature in the burner may be kept relatively constant during operation, however, the amount of fuel, and consequently the output, may be varied e.g. depending on day or night operation. An increased turndown ratio of a cyclone burner facilitates the changing between the need for more or less output. In prior art burners it may sometimes be necessary to interrupt the operation of the burner, because it is not possible to produce a sufficiently low output, and therefore when larger output again is desired, the burner has to be re-started. The present inventive idea, however, provides a larger possible regulating range.

DETAILED DESCRIPTION OF THE DRAWINGS

Figure 1:
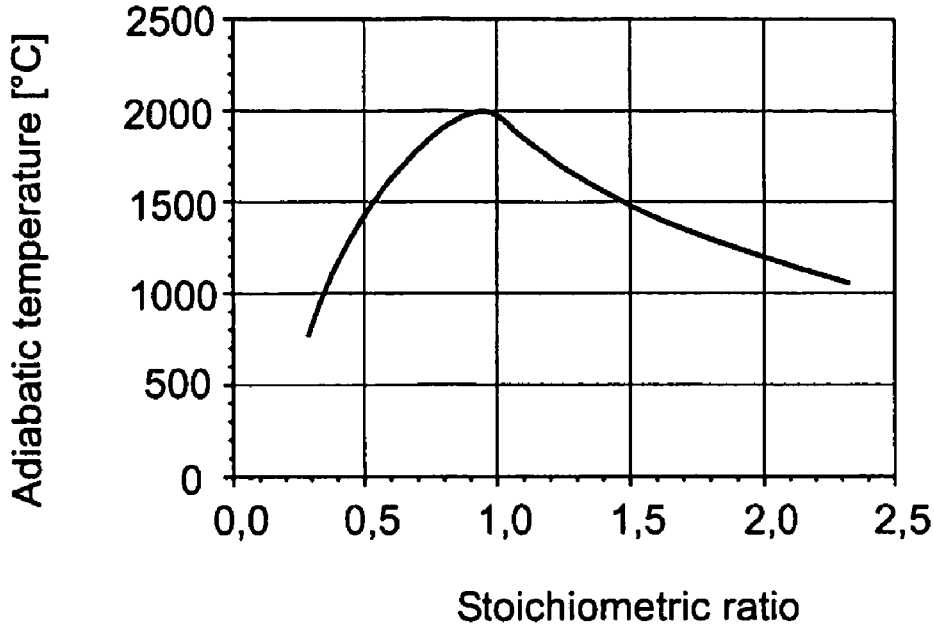
FIG. 1 is a diagram illustrating the relationship between stoichiometric ratio and adiabatic temperature when wood pellets are used as fuel.

FIG. 1 is a diagram illustrating the relationship between stoichiometric ratio and adiabatic temperature when wood pellets are used as fuel. The wood pellets may have a lower heating value (or net calorific value) of 18.2 MJ/kg. The diagram shows that the highest temperature is obtained for a stoichiometric ratio of approximately 0.95. If more oxygen is provided in relation to what is needed for complete combustion of the fuel, i.e. an over stoichiometric condition, the temperature becomes lower. For instance, a stoichiometric ratio of 2.0 results in an adiabatic temperature of 1200° C. Similarly, if less oxygen is provided so as to achieve a more sub-stoichiometric condition, the temperature will also become lower. For instance a stoichiometric ratio of 0.5 would result in a temperature of approximately 1400° C. As described previously, in order to obtain satisfactory operability, it may be desirable to keep the temperature within a certain range. Thus, for this particular fuel, if it would be desirable to operate within the temperature range of 1100° C.-1300° C., the sub- and over-stoichiometric ratios would be held at approximately 0.37-0.45 and 1.8-2.25, respectively.

Figure 2:
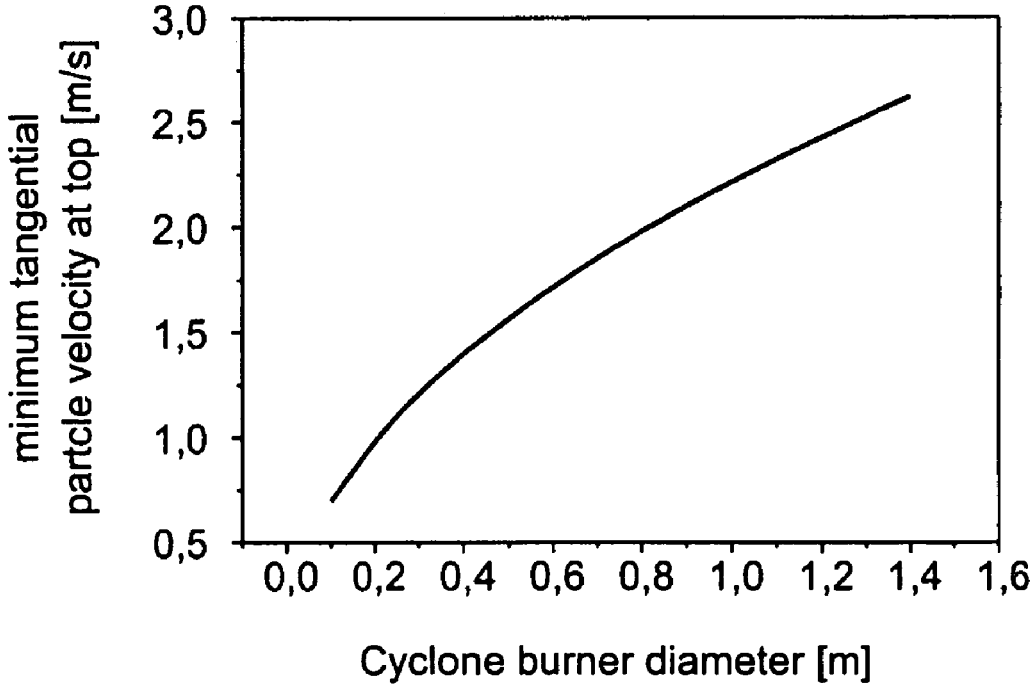
FIG. 2 is a diagram illustrating the theoretical minimum particle velocity at the top of a combustion chamber as a function of the combustion chamber diameter.

FIG. 2 is a diagram illustrating the theoretical minimum particle velocity at the top portion of the combustion chamber of a lying cyclone burner as a function of the combustion chamber diameter. As has been described previously, the lower limiting gas flow is set by the case in which a particle at the highest position (the top) of the combustion chamber is just prevented from falling down. If the radial drag is assumed to be negligible, the tangential particle velocity ($V_{p,t}$) is $V_{p,t}=\sqrt{gR}$. This is illustrated in FIG. 2. For instance, a combustion chamber having a diameter of 0.3 m, 0.6 m or 1.2 m would result in a minimum particle velocity at the top of 1.2 m/s, 1.7 m/s and 2.4 m/s, respectively.

Figure 3:
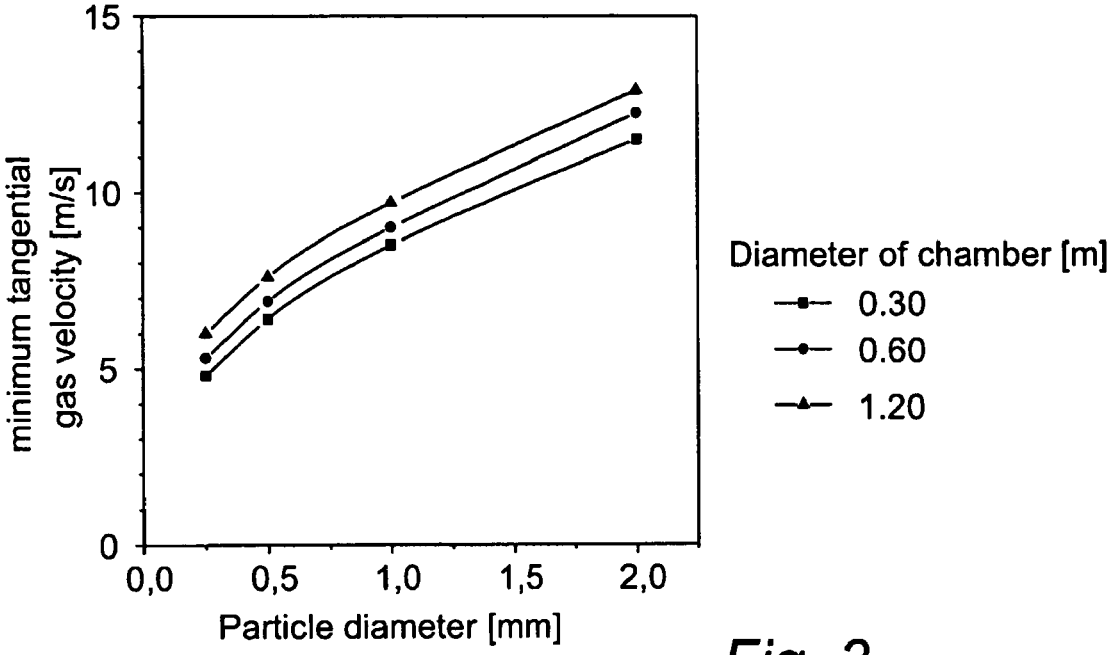
FIG. 3 is a diagram illustrating the calculated lower limiting gas velocity as a function of particle diameter and combustion chamber diameter.

FIG. 3 is a diagram illustrating the calculated lower limiting gas velocity as a function of particle diameter and combustion chamber diameter in a lying cyclone burner. The tangential gas velocity ($V_{g,t}$) must be higher than the minimum particle velocity ($V_{p,t}$). As has been described previously, the tangential gas velocity $V_{g,t}$ should be so high that the particle velocity at the upper position ($\phi$=180°) in the combustion chamber of the cyclone burner is higher than the calculated minimum particle velocity ($V_{p,t}$). Using this as boundary condition the gas velocity is solved from the following differential equation $$C_d A_p \rho_g \frac{[V_{g,t} - V_{p,t}]^2}{2} - \mu m_p \left[ g \cos(\varphi) + \frac{V_{p,t}^2}{R} \right] - m_p g \sin(\varphi) = m_p V_{p,t} \frac{\delta V_{p,t}}{\delta S}$$

One finds that the lower limiting gas velocity ($V_{g,t}$) increases as the radius of the combustion chamber of the cyclone burner and the particle diameter increase. This is illustrated in FIG. 3. The horizontal axis in the diagram represents the particle diameter in mm and the vertical axis represents the lower limiting gas velocity in m/s. Three curves are drawn, wherein the bottom curve is for a combustion chamber diameter of 0.3 m, the middle curve is for a combustion chamber diameter of 0.6 m and the top curve is for a combustion chamber diameter of 1.2 m. For the calculations a friction factor of 0.5, a drag coefficient of 0.44, a gas density of 0.28 kg/m$^3$ and a particle density of 1000 kg/m$^3$ have been assumed. The diagram shows that for a particle diameter of e.g. 2.0 mm (e.g. crushed wood pellet) the lower limiting gas velocity is about 11 to 13 m/s depending on the size of the combustion chamber. For a smaller particle diameter of e.g. 0.5 mm (such as crushed pellet) the lower limiting gas velocity is as low as 6 to 8 m/s.

When fuel particles enter the combustion chamber of the cyclone burner they will rapidly release their volatile matter.

Figure 4:
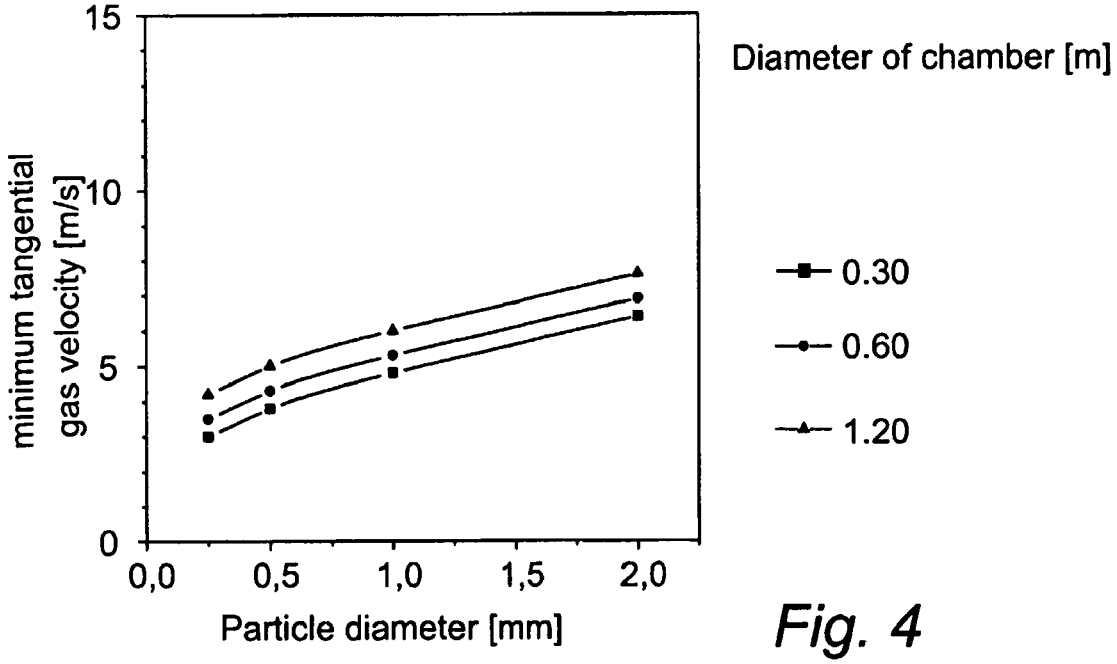
FIG. 4 is another diagram illustrating the calculated lower limiting gas velocity as a function of particle diameter and combustion chamber diameter.

Thus, the particle density will also decrease. It may therefore be suitable to calculate the lower limiting gas velocity based on the particle density after devolatilisation. For wood particles this density is typically in the magnitude of 250 kg/m$^3$. This is shown in FIG. 4. Thus, all input data is the same as for the diagram shown in FIG. 3, except for the particle density which in FIG. 4 is 250 kg/m$^3$ instead of 1000 kg/m$^3$. For a particle diameter of 0.5 mm the lower limiting gas velocity is about 3 to 5 m/s, which is enough for obtaining the minimum particle velocity (1.2 m/s, 1.7 m/s and 2.4 m/s) calculated above for the different combustion chamber diameters. If the upper limiting gas velocity, which has been found empirically, is about 30 m/s, the turn down ratio for a given combustion temperature and a particle of diameter 0.5 mm would be about 30:5, i.e. 6:1. The turn down ratio can be further extended if also the combustion temperature is allowed to be varied with the load.

Figure 5:
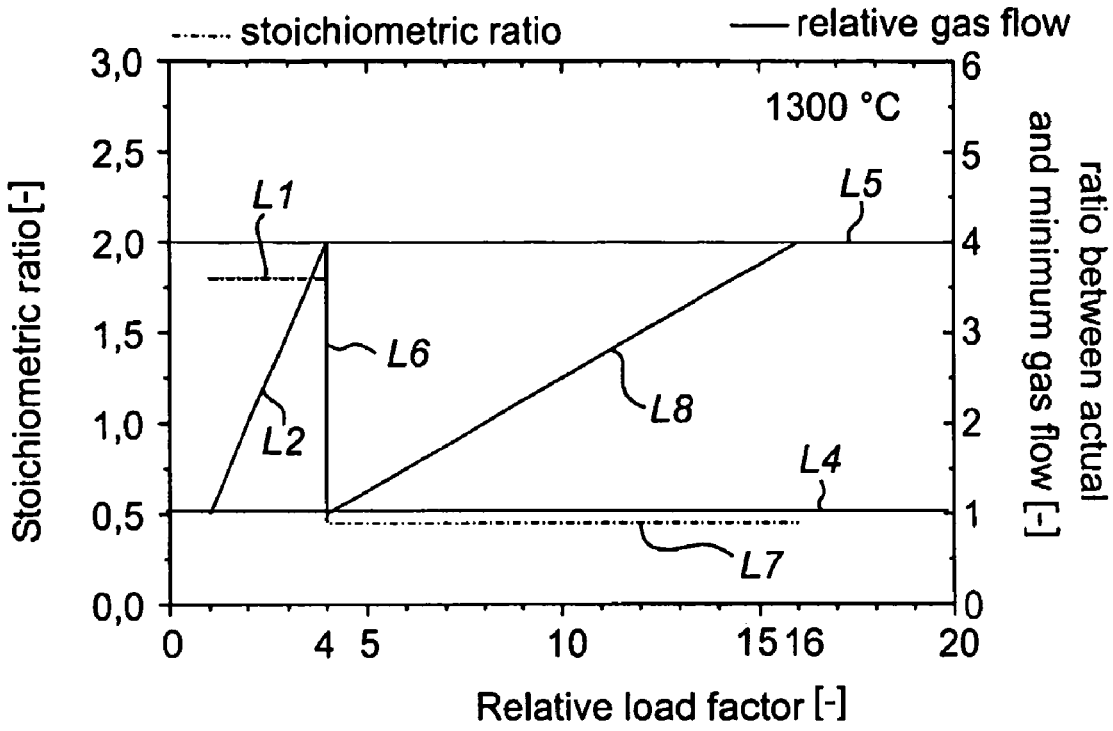
FIG. 5 is a diagram illustrating the turndown ratio depending on the stoichiometric ratio and the relative gas flow.

FIG. 5 is a diagram illustrating the turndown ratio depending on the stoichiometric ratio and the relative gas flow. In this example an adiabatic temperature of about 1300° C. is presumed in the combustion chamber of the cyclone burner. The horizontal axis represents the relative load factor of the cyclone burner. The left vertical axis represents the stoichiometric ratio inside the combustion chamber. The right vertical axis represents the relative gas flow inside the combustion chamber, i.e. the ratio between the actual gas flow and the minimum gas flow, or in most cases the ratio between the actual gas velocity and the lower limiting gas velocity.

Looking at the left part of the diagram, when a relatively small amount of fuel, i.e. a small load, is fed into the combustion chamber, a comparatively large amount of oxygen-containing combustion gas such as air is supplied so that an over-stoichiometric condition exists in the combustion chamber. The stoichiometric ratio is kept at about 1.8, as illustrated by the dashed line L1, in order to maintain the temperature of about 1300° C. As the load is increased the amount of combustion gas is also increased by increasing the velocity with which it is fed into the combustion chamber, thereby maintaining an over-stoichiometric condition. This is shown by the inclined left portion of the curve L2. In this case the stoichiometric ratio is kept essentially constant at 1.8. The amount of load to be operated at over-stoichiometric condition is determined by the lower limiting gas velocity and the upper limiting gas velocity being typically 4 times the lower one. The limiting gas velocities are indicated by the horizontal lines L4 (lower limit) and L5 (upper limit) across the diagram. Thus, as the load is increased from a relative load factor of 1 on the horizontal scale, and consequently also the gas velocity, one will eventually reach the upper limiting gas velocity. This happens at 4 on the horizontal scale. A cyclone burner operated at over-stoichiometric condition would thus be limited to a turndown ratio of 4:1.

Having reached the upper limiting gas velocity at over-stoichiometric condition, a shifting operation is performed so as to obtain a sub-stoichiometric condition, thereby allowing further increase of the load. The act of shifting to a sub-stoichiometric condition is performed by reducing the velocity of the gas before the velocity of the gas reaches or passes above said upper limiting gas velocity, as indicated by line L6. In this case it coincides with the lower limiting gas velocity at a sub-stoichiometric ratio of about 0.45 (at 4 on the horizontal scale), in order to maintain the temperature at about 1300° C. Now, instead of having excess of oxygen, there is a shortage of oxygen. The sub-stoichiometric ratio of about 0.45 is kept essentially constant, as illustrated by the dashed line L7, while the amount of fuel fed into the combustion chamber is allowed to be further increased. The amount of fuel may be increased, and therefore also the gas flow as indicated by line L8, up to such a load where the upper limiting gas velocity is reached. This is at 16 on the horizontal scale. This means that if a cyclone burner would only be operated at this sub-stoichiometric ratio, a turndown ratio of 16:4, i.e. 4:1 would be obtained. By combining the two operational modes, making use of both stoichiometric conditions, a theoretical turndown ratio of 16:1 is obtainable.

The process is reversible. Thus, it is possible to start at the right side of the curve in FIG. 5, i.e. at a sub-stoichiometric condition. As the load is reduced, and therefore also the gas velocity, the lower limiting gas velocity is eventually reached. At this point, shifting is made to over-stoichiometric ratio by increasing the gas velocity. Thereafter, the load may be decreased even further, until the gas velocity is reduced, for maintaining the essentially constant over-stoichiometric ratio, to the lower limiting gas velocity.

Figure 6:
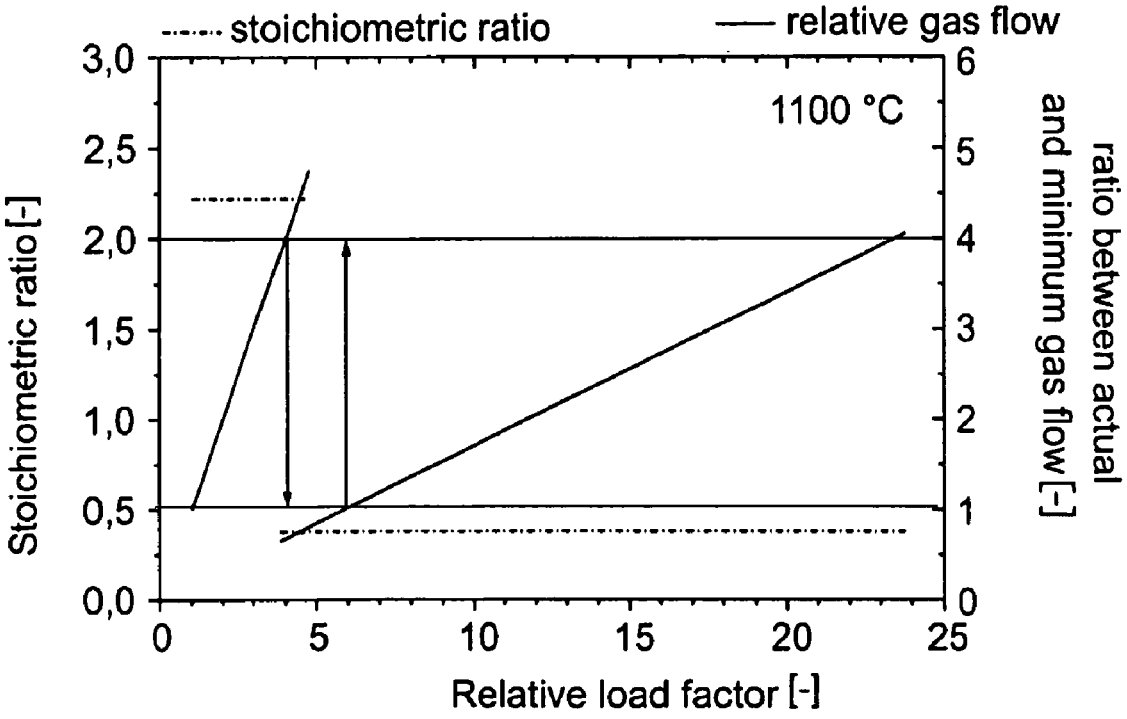
FIG. 6 is a another diagram illustrating the turndown ratio.

FIG. 6 is another diagram illustrating the turndown ratio. In this case, the same fuel is used in the same combustion chamber as in FIG. 5. However, now an adiabatic temperature of about 1100° C. is desired inside the combustion chamber. This temperature is obtained for an over-stoichiometric ratio of about 2.2, and for a sub-stoichiometric ratio of about 0.38. As can be seen from FIG. 6, indicated by an arrow pointing downwards, a shift from the over-stoichiometric condition at the upper limiting gas velocity to sub-stoichiometric condition would lead to a gas velocity below the lower limiting gas velocity. Similarly, a shift from the sub-stoichiometric condition, when having the lower limiting gas velocity, to the over-stoichiometric condition, would as indicated by the arrow pointing upwards result in gas velocity far above the upper limiting gas velocity. This means that in order to keep the desired temperature and to obtain an overlap, when shifting from one stoichiometric condition to the other, the gas velocity will go past the upper and/or lower limiting gas velocities.

The difficulty illustrated in FIG. 6 is overcome by adding re-circulated flue gases having low or no oxygen content to the combustion gas having high oxygen content, such as air.

Figure 7:
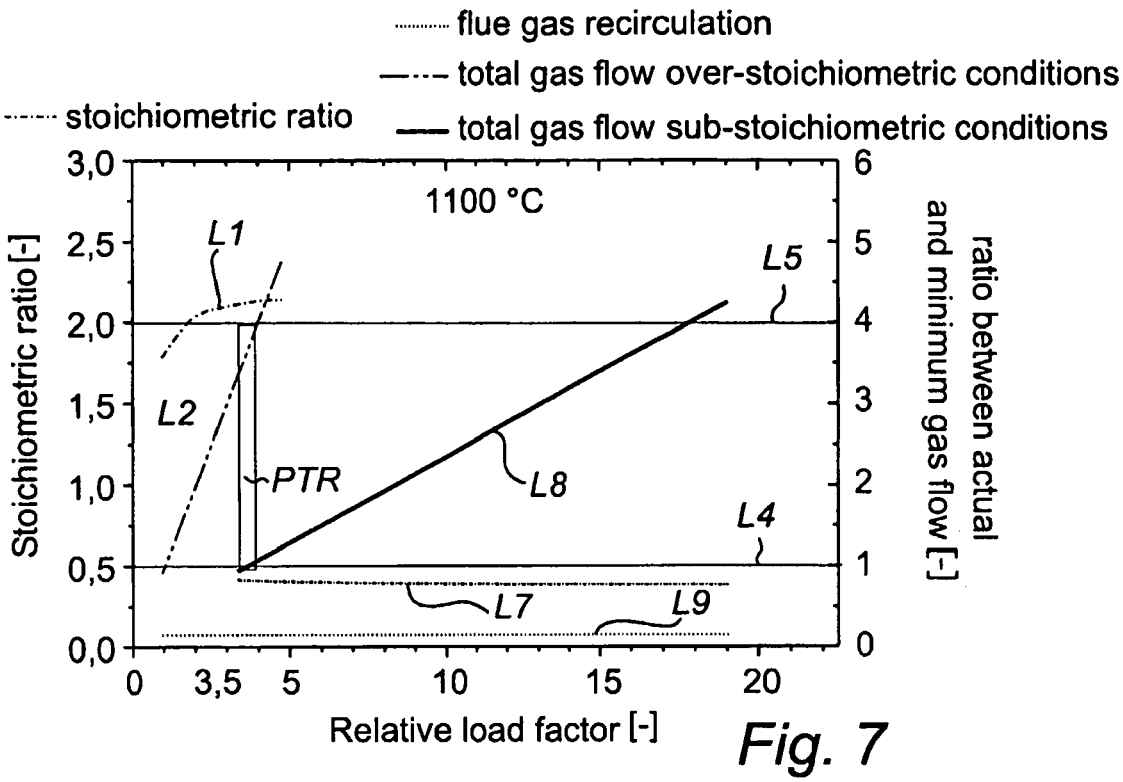
FIG. 7 is a diagram illustrating the turndown ratio in the case of recirculated flue gases being added to the combustion gas.

Accordingly, FIG. 7 is a diagram illustrating the turndown ratio in the case of recirculated flue gases being added to the combustion gas. As in FIG. 6, the desired temperature in the combustion chamber is 1100° C. A fixed amount of recirculated flue gas (15% of the minimum gas flow) is mixed into the combustion gas before feeding it to the combustion chamber. The amount of recirculated flue gas is illustrated as a straight horizontal dotted line L9 at the bottom portion of the diagram. Lines corresponding to the lines in FIG. 5 have been denoted with the same references.

As can be seen from the diagram in FIG. 7, the minimum load under sub-stoichiometric conditions is further extended now that recirculated flue gas is applied. The recirculated flue gas increases the total gas flow without increasing the heat released from the fuel. Thus, the minimum limit of gas flow, i.e. the lower limiting gas velocity, is reached at a lower load. Furthermore, the recirculated flue gas serves as ballast. Additional combustion gas is therefore demanded in order to maintain the desired temperature. This further increases the total gas flow, and the minimum limit is reached at a further decreased load. According to the diagram in FIG. 7 this limit is at about 3.5 on the horizontal scale, instead of about 6 as in FIG. 6.

Under over-stoichiometric condition the added flue gas will partly replace excess combustion gas. Thus, the total gas flow will remain the same as without any flue gas recirculation, but the stoichiometric ratio will vary between about 1.8 and 2.1 as the load changes (see the dashed line L1). The benefit is that the oxygen concentration will decrease as the load decreases, resulting in less nitrogen oxide being formed. Thus, in the diagram in FIG. 7, and in the diagram in FIG. 6, the upper load limit for over-stoichiometric conditions is reached at 4 on the horizontal scale. While there is no overlap in FIG. 6, an overlap and therefore a possible transition region PTR is obtained in the diagram of FIG. 7 due to the extension of the minimum load under sub-stoichiometric conditions. The possible transition region PTR is defined by the lower limiting velocity at sub-stoichiometric condition and the upper limiting velocity at over-stoichiometric condition. Instead of having a "thin" line L6 as shown in FIG. 5, a broader possible transition region PTR is obtained in the case shown in FIG. 7. This means that, in the case shown in the diagram, it is not necessary to wait until a limiting gas velocity is reached in order to make the shift to the other stoichiometric condition. Instead the shift may be performed at an earlier point when the amount of fuel is such that it does not pass outside the limit set by the other limiting gas velocity for the other stoichiometric condition. For example, when changing from sub-stoichiometric to over-stoichiometric condition the shift may be done at a load amount corresponding to 4 (upper limit, over-stoichiometric) on the horizontal scale in FIG. 7, or later as far down as a load amount corresponding to about 3.5 (lower limit, sub-stoichiometric) on the horizontal scale. It may be noted that the turndown ratio, according to the diagram in FIG. 7, is 18:1. However, since a given cyclone burner has a maximum load capacity, i.e. an accumulation limit due to accumulation of burning devolatilised particles, and since the gas velocity is proportional to the load, it is quite possible that this maximum load will be reached before the gas velocity at sub-stoichiometric conditions has reached the upper limiting gas velocity. Thus, the maximum load capacity or the accumulation limit indirectly determines the velocity limit. However, an advantage is that the span (turn down ratio) within which it is possible to operate at sub-stoichiometric conditions is enlarged, this being preferred from an environmental point of view since less nitrogen oxide is formed. This is further illustrated in FIG. 8.

Figure 8:
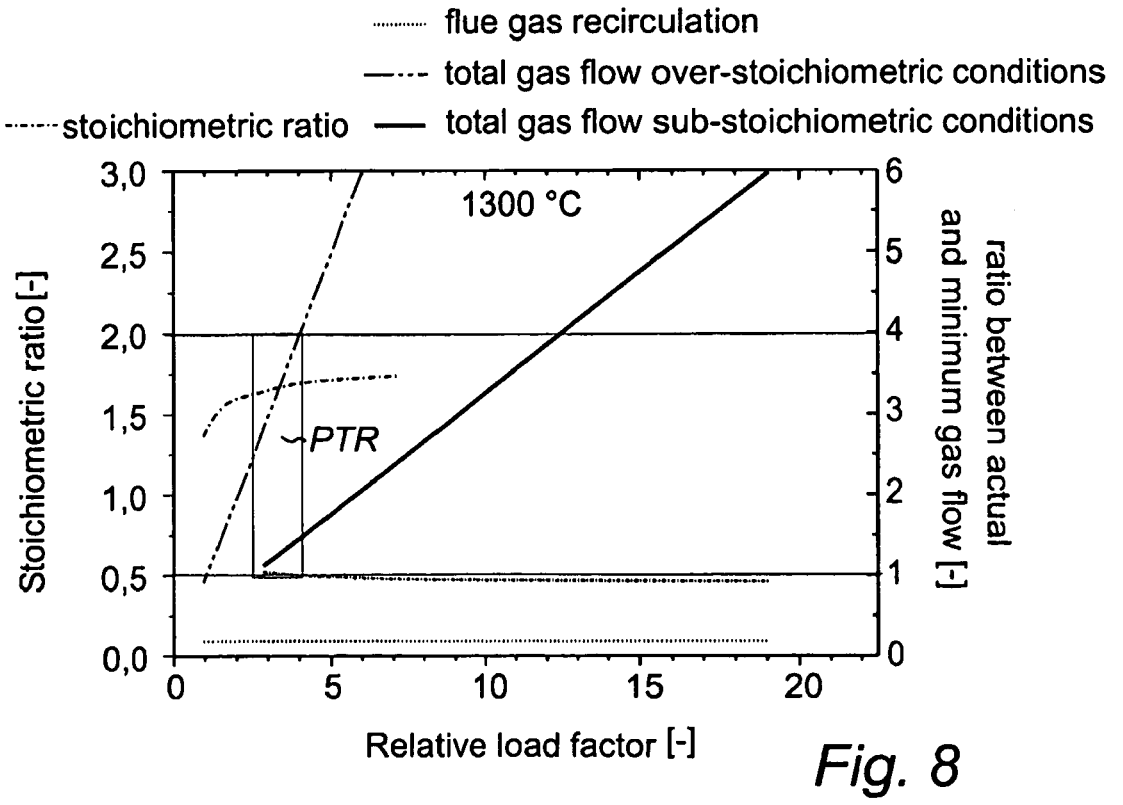
FIG. 8 is another diagram illustrating the turndown ratio in the case of recirculated flue gases being added to the combustion gas.

FIG. 8 is another diagram illustrating the turndown ratio in the case of recirculated flue gases being added to the combustion gas. In this case the desired temperature is 1300° C., and the diagram is drawn for the same type of fuel in the same cyclone burner as for FIG. 5. However, FIG. 8 illustrates a 15% recirculation of flue gas in the combustion gas. Comparing the diagrams in these two Figures, it is obvious that the possible transition region is larger when recirculated flue gas is used, since the minimum load at sub-stoichiometric conditions is moved further to the left in the diagram in FIG. 8. Even though it is preferred to operate as much as possible at over-stoichiometric conditions, the use of flue gas may negatively affect the overall turndown ratio if the flue gas recirculation is not withdrawn at a higher load. In FIG. 8, for instance, the overall turndown ratio is about 12.5:1 instead of 16:1 as in FIG. 5.

Figure 9:
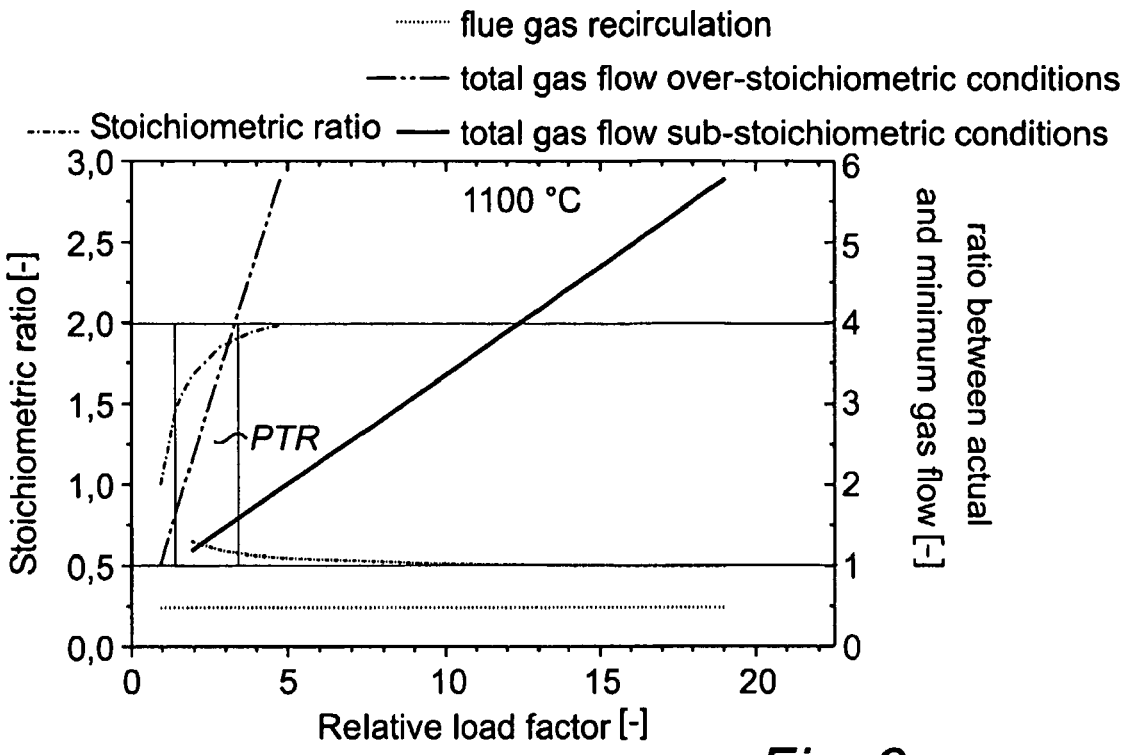
FIG. 9 is yet another diagram illustrating the turndown ratio in the case of recirculated flue gases being added to the combustion gas.
Figure 10:
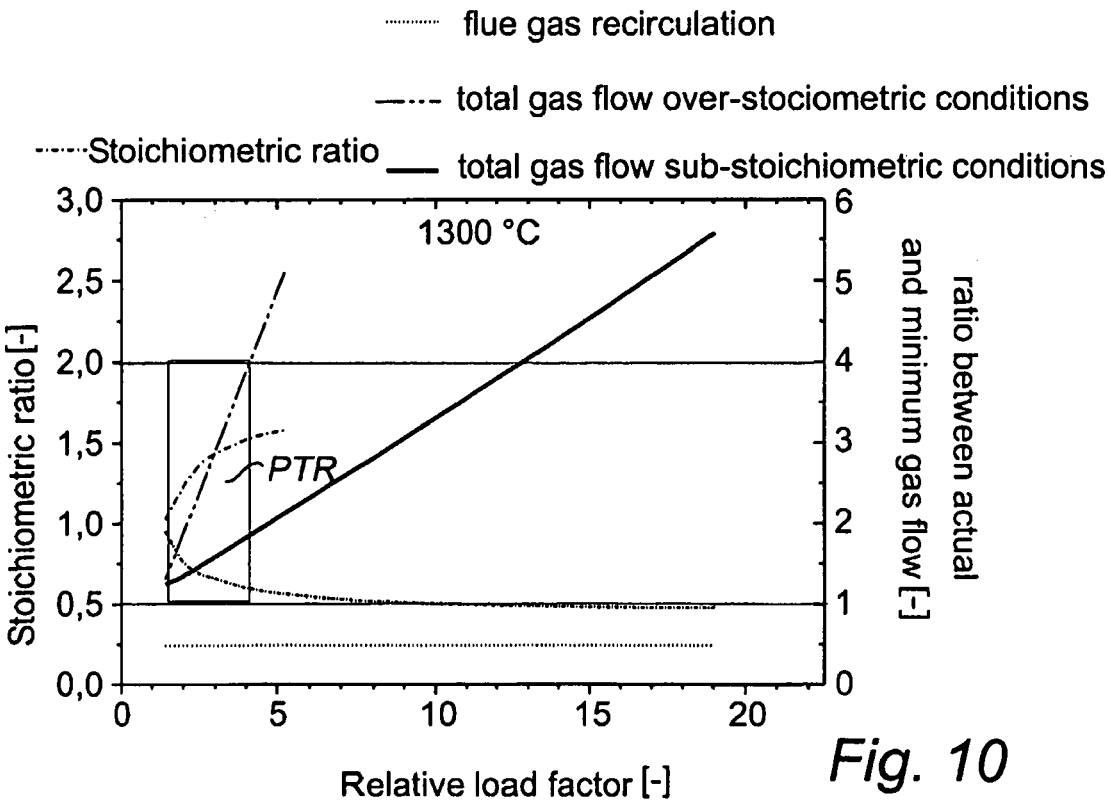
FIG. 10 is a further diagram illustrating the turndown ratio in the case of recirculated flue gases being added to the combustion gas.

FIGS. 9 and 10 illustrate the effect of a larger part of the introduced gas being recirculated flue gas. In these examples the recirculated flue gas is 45% of the minimum gas flow, and in FIG. 9 the desired temperature is 1100° C., while in FIG. 10 the desired temperature is 1300° C. It may be noticed that this higher recirculation of flue gas results in a larger possible transition region. It may also be noticed, in FIG. 10, that the operational range at sub-stoichiometric combustion is nearly extended to a relative load factor of 1.

Figure 11:
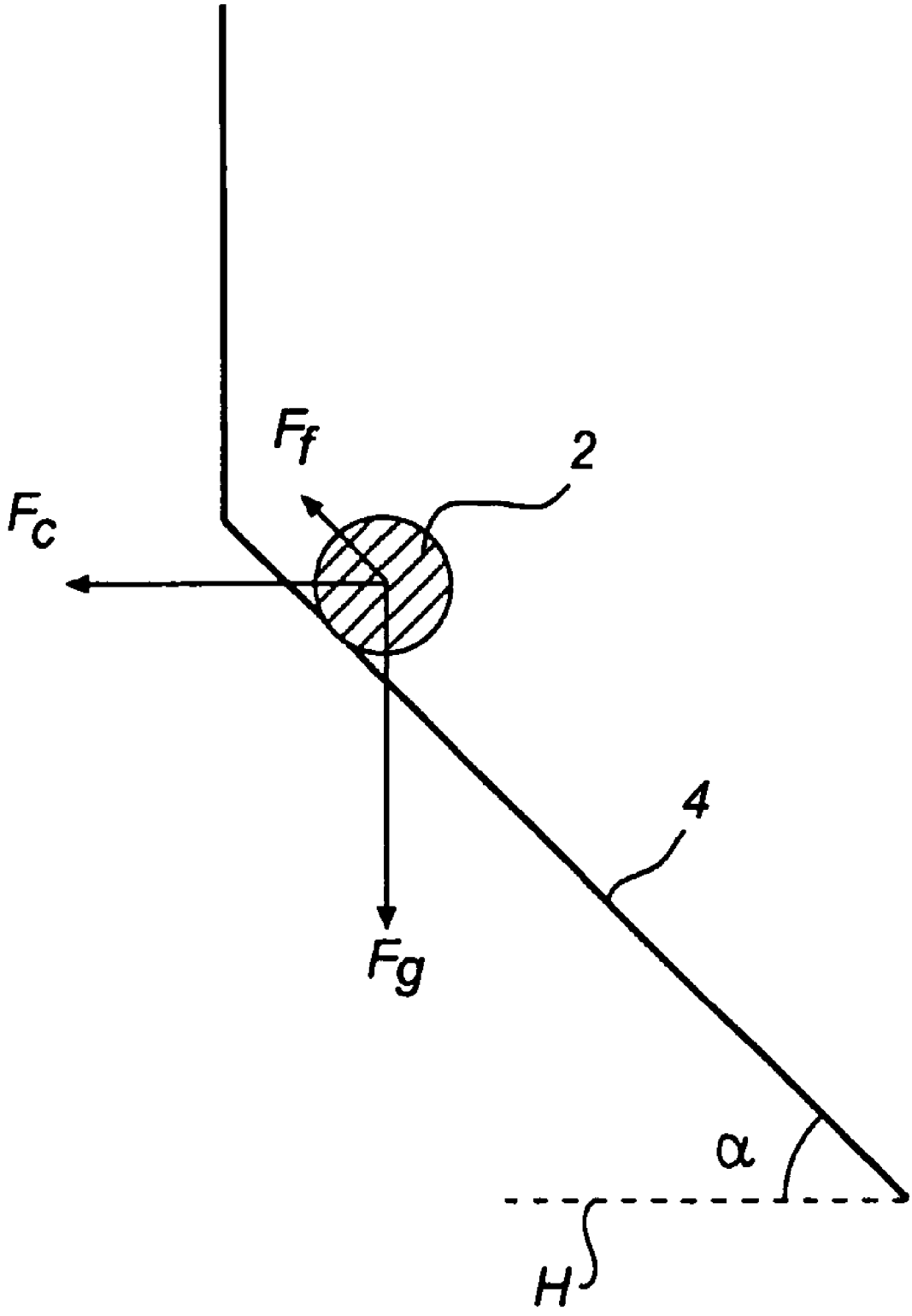
FIG. 11 illustrates forces acting on a particle in a standing cyclone burner.

In the following, FIG. 11 will be discussed for deriving the lower limiting tangential gas velocity for a "standing" cyclone burner, i.e. comprising a combustion chamber having a central axis of symmetry extending vertically and a circular cross-section in the horizontal plane. In the corresponding manner as for a lying cyclone, the limiting gas velocity is set by the particles falling down vertically.

In the following it is assumed that fuel particles are not carried out through the outlet of the combustion chamber. For simplifying reasons the gas flow is described as a horizontal rotating flow (no vertical drag force) and the radial gas flow is considered as negligible, resulting in an equilibrium of forces acting on a fuel particle 2 as illustrated in FIG. 11. The fuel particle abuts an inner wall 4 of the combustion chamber. In order to prevent the particle from falling down, the gravitational force $F_g$ is balanced by the frictional force $F_f$ and centrifugal force $F_c$ in the direction of the inclined plane, said plane being inclined with an angle α from the horizontal plane H.

$$F_f+F_c\cos(\alpha)=F_g\sin(\alpha)$$

The centrifugal force $F_c$ and the gravitational force $F_g$ may be expressed as:

$$F_c = m_p\frac{V_{p,t}^2}{R}$$

$$F_g=m_p g$$

wherein $m_p$ is the mass of the particle, $V_{p,t}$ is the tangential velocity of the particle, R is the radius of the combustion chamber of the cyclone burner and g is the gravitational constant. The frictional force $F_f$ is proportional to a normal force $F_N$ according to:

$$F_f=\mu F_N$$

$$F_N=F_g\cos(\alpha)+F_c\sin(\alpha)$$

$$F_f = \mu m_p\left[g\cos(\alpha) + \frac{V_{p,t}^2}{R}\sin(\alpha)\right]$$

wherein μ is the friction factor or frictional coefficient. This leads to the following relation.

$$F_f+F_c\cos(\alpha)=F_g\sin(\alpha)$$

$$\mu m_p\left[g\cos(\alpha) + \frac{V_{p,t}^2}{R}\sin(\alpha)\right] + m_p\frac{V_{p,t}^2}{R}\cos(\alpha) = m_p g\ \sin(\alpha)$$

$$\mu\left[1 + \frac{V_{p,t}^2}{gR}\tan(\alpha)\right] + \frac{V_{p,t}^2}{gR} = \tan(\alpha)$$

$$\tan(\alpha) = \frac{\mu + \frac{V_{p,t}^2}{gR}}{1 - \mu\frac{V_{p,t}^2}{gR}}$$

Thus, the minimum tangential particle velocity will be:

$$V_{p,t} = \sqrt{gR\frac{\tan(\alpha) - \mu}{\mu\tan(\alpha) + 1}}$$

From the above it is clear that it is possible to have a steeper inclination if a) the radius R is decreased, b) the tangential particle velocity $V_{p,t}$ is increased, or c) the frictional coefficient μ is increased.

In order to maintain the tangential particle velocity, the tangential drag force $F_{d,t}$ has to balance the frictional force $F_f$. The frictional force is equal in all directions.

$$F_{d,t} = C_d A_p \rho_g \frac{[V_{g,t} - V_{p,t}]^2}{2}$$

wherein $C_d$ is the drag coefficient, $A_p$ is the cross-sectional area of a fuel particle, $\rho_g$=density of the combustion gas and $V_{g,t}$=tangential gas velocity.

$$F_f = \mu m_p\left[g\cos(\alpha) + \frac{V_{p,t}^2}{R}\sin(\alpha)\right] = \rho_g A_p Cd\frac{(V_{g,t} - V_{p,t})^2}{2}$$

Thus, the minimum tangential gas velocity will be:

$$V_{g,t} = V_{p,t} + \sqrt{\frac{2\mu m_p}{\rho_g A_p Cd}\left[g\cos(\alpha) + \frac{V_{p,t}^2}{R}\sin(\alpha)\right]}$$

Substituting the mass $m_p$ with the particle density $\rho_p$ times the volume of the particle, $d_p$ being the diameter of the particle, and rewriting the cross-sectional area $A_p$ of the particle $$m_p = \rho_p\frac{4}{3}\pi\left(\frac{d_p}{2}\right)^3$$

$$A_p = \pi\left(\frac{d_p}{2}\right)^2 \text{ gives}$$

$$V_{g,t} = V_{p,t} + \sqrt{\frac{4}{3}d_p\frac{\rho_p}{\rho_g}\frac{\mu}{Cd}\left[g\cos(\alpha) + \frac{V_{p,t}^2}{R}\sin(\alpha)\right]}$$

By substituting the expression for the minimum tangential particle velocity the following equation is obtained.

$$V_{g,t} = \sqrt{gR\frac{\tan(\alpha) - \mu}{\mu\tan(\alpha) + 1}} + \sqrt{\frac{4}{3}d_p\frac{\rho_p}{\rho_g}\frac{\mu}{Cd}\left[g\cos(\alpha) + g\frac{\tan(\alpha) - \mu}{\mu\tan(\alpha) + 1}\sin(\alpha)\right]}$$

The larger or heavier the particle, the larger combustion chamber radius and higher tangential gas velocity required. Furthermore, the lower limiting gas velocity is increased as the angle α is increased and the frictional coefficient is decreased.

The invention claimed is:

1. A method of operating a combustion process in a non-slagging cyclone burner, after start-up thereof, comprising the steps of:

feeding a fuel into a cylindrically shaped combustion chamber of the non-slagging cyclone burner;

feeding an oxygen-containing combustion gas with a tangential velocity into said combustion chamber, a lower limiting gas velocity and an upper limiting gas velocity being defined for said combustion gas;

keeping the velocity of the combustion gas between said limiting gas velocities;

maintaining after start-up one of two stoichiometric conditions: sub-stoichiometric condition and over-stoichiometric condition, by controlling the amount of fed oxygen to the amount of fed fuel; and shifting to the other one of said two stoichiometric conditions while preventing the combustion gas from obtaining a velocity outside the range defined by the lower limiting gas velocity and the upper limiting gas velocity.

2. The method as claimed in claim 1, further comprising:

maintaining the temperature in the combustion chamber in the temperature range of 700° C.-1300° C., wherein each temperature point in said temperature range defines, together with said limiting gas velocities, a respective minimum fuel load and a respective maximum fuel load for shifting from one of the two stoichiometric conditions to the other one.

3. The method as claimed in claim 2, further comprising:

mixing recirculated flue gases, or other low oxygen-containing gas or inert gas, with the oxygen-containing combustion gas prior to feeding the combustion gas into the combustion chamber, thereby reducing said minimum fuel load under sub-stoichiometric conditions.

4. The method as claimed in claim 2, further comprising:

mixing recirculated flue gases, or other low oxygen-containing gas or inert gas, with the oxygen-containing combustion gas prior to feeding the combustion gas into the combustion chamber, thereby reducing, at the same total gas flow, the oxygen concentration and thereby the formation of nitrogen oxides under over-stoichiometric conditions.

5. The method as claimed in claim 1, wherein the act of maintaining a stoichiometric condition comprises keeping an essentially constant stoichiometric ratio in order to control the temperature.

6. The method as claimed in claim 2, wherein the stoichiometric ratio is kept within defined limits while the temperature in the combustion chamber is controlled by the amount of said recirculated flue gas, or other low oxygen-containing gas or inert gas to be mixed with the oxygen-containing combustion gas.

7. The method as claimed in claim 1, comprising feeding said fuel in the form of solid fuel particles.

8. The method as claimed in claim 7, comprising:

controlling, for a relatively small amount of fuel being fed into the combustion chamber, the amount of combustion gas so that an over-stoichiometric condition prevails in the combustion chamber;

increasing, when the amount of fuel is increased, the amount of combustion gas, by increasing the velocity with which it is fed into the combustion chamber, thereby maintaining an over-stoichiometric condition;

shifting to a sub-stoichiometric condition by reducing the relative amount of combustion gas, by reducing the velocity of the combustion gas, before the velocity of the gas reaches said upper limiting gas velocity or when the amount of fuel is such that a sub-stoichiometric condition is obtainable that meets the criteria of the temperature in the combustion chamber being 700° C.-1300° C., and the velocity of the gas being equal to or higher than said lower limiting gas velocity.

9. The method as claimed in claim 8, wherein, after shifting to a sub-stoichiometric condition, the method further comprising:

increasing, when the amount of fuel is further increased, the amount of combustion gas by increasing the velocity with which it is fed into the combustion chamber, while maintaining a sub-stoichiometric condition.

10. The method as claimed in claim 7, comprising:

controlling, for a relatively large amount of fuel being fed into the combustion chamber, the amount of combustion gas so that a sub-stoichiometric condition prevails in the combustion chamber;

reducing, when the amount of fuel is reduced, the amount of combustion gas, by reducing the velocity with which it is fed into the combustion chamber, thereby maintaining a sub-stoichiometric condition;

shifting to an over-stoichiometric condition by increasing the relative amount of combustion gas, by increasing the velocity of the combustion gas, before the velocity of the gas reaches said lower limiting gas velocity or when the amount of fuel is such that an over-stoichiometric condition is obtainable that meets the criteria of the temperature in the combustion chamber being 700° C.-1300° C., and the velocity of the gas being equal to or lower than said upper limiting gas velocity.

11. The method as claimed in claim 10, wherein, after shifting to the over-stoichiometric condition, the method further comprising:

reducing, when the amount of fuel is further reduced, the amount of combustion gas by reducing the velocity with which it is fed into the combustion chamber, while maintaining an over-stoichiometric condition.

12. The method as claimed in claim 7, in which said lower limiting gas velocity is the lowest velocity for keeping at least a majority of the fuel particles circulating in the combustion chamber.

13. The method as claimed in claim 7, wherein, for the non-slagging cyclone burner with a combustion chamber having a central axis of symmetry extending horizontally, the tangential lower limiting gas velocity $V_{g,t}$ at the top of the combustion chamber is calculated by solving the following differential equation:

$$C_d A_p \rho_g \frac{[V_{g,t} - V_{p,t}]^2}{2} - \mu m_p \left[ g\cos(\varphi) + \frac{V_{p,t}^2}{R} \right] - m_p g \sin(\varphi) = m_p V_{p,t} \frac{\delta V_{p,t}}{\delta S}$$

fulfilling the boundary condition $V_{p,t}=\sqrt{gR}$ for=180° wherein $\mu$=friction factor $C_d$=drag coefficient $A_p$=cross-sectional area of a fuel particle $\rho_g$=density of the combustion gas $\phi$=the angle to the vertical, i.e. 180° at the top of the combustion chamber $V_{g,t}$=tangential gas velocity $V_{p,t}$=tangential particle velocity m/p=mass of a particle g=gravitational constant R=radius of the combustion chamber of the non-slagging cyclone burner S=the distance traveled along the periphery by the particle.

14. The method as claimed in claim 7, wherein, for the non-slagging cyclone burner with a combustion chamber having a central axis of symmetry extending vertically, the tangential lower limiting gas $V_{g,t}$ is calculated by solving the following equation:

$$V_{g,t} = \sqrt{gR\frac{\tan(\alpha) - \mu}{\mu\tan(\alpha) + 1}} + \sqrt{\frac{4}{3} d_p \frac{\rho_p}{\rho_g} \frac{\mu}{Cd} \left[ g\cos(\alpha) + g\frac{\tan(\alpha) - \mu}{\mu\tan(\alpha) + 1}\sin(\alpha) \right]}$$

wherein $V_{g,t}$=tangential gas velocity g=gravitational constant

R=radius of the combustion chamber of the non-slagging cyclone burner $\alpha$=the angle to the horizontal $\mu$=friction factor $d_p$=diameter of a fuel particle $\rho_p$=density of a fuel particle $\rho_g$=density of the combustion gas $C_d$=drag coefficient.

15. The method as claimed in claim 7, in which said upper limiting gas velocity is the highest velocity allowable for preventing a large amount of unburned fuel particles from leaving the combustion chamber, said velocity being 20-50 m/s.

16. The method as claimed in claim 2, wherein the act of maintaining a stoichiometric condition comprises keeping an essentially constant stoichiometric ratio in order to control the temperature.

17. The method as claimed in claim 3, wherein the stoichiometric ratio is kept within defined limits while the temperature in the combustion chamber is controlled by the amount of said recirculated flue gas, or other low oxygen-containing gas or inert gas to be mixed with the oxygen-containing combustion gas.

18. The method as claimed in claim 7, further comprising:

maintaining the temperature in the combustion chamber in the temperature range of 700° C.-1300° C., wherein each temperature point in said temperature range defines, together with said limiting gas velocities, a respective minimum fuel load and a respective maximum fuel load for shifting from one of the two stoichiometric conditions to the other one.

19. The method as claimed in claim 18, further comprising:

mixing recirculated flue gases, or other low oxygen-containing gas or inert gas, with the oxygen-containing combustion gas prior to feeding the combustion gas into the combustion chamber, thereby reducing said minimum fuel load under sub-stoichiometric conditions.

20. The method as claimed in claim 18, further comprising:

mixing recirculated flue gases, or other low oxygen-containing gas or inert gas, with the oxygen-containing combustion gas prior to feeding the combustion gas into the combustion chamber, thereby reducing, at the same total gas flow, the oxygen concentration and thereby the formation of nitrogen oxides under over-stoichiometric conditions.

21. The method as claimed in claim 7, wherein the act of maintaining a stoichiometric condition comprises keeping an essentially constant stoichiometric ratio in order to control the temperature.

22. The method as claimed in claim 18, wherein the stoichiometric ratio is kept within defined limits while the temperature in the combustion chamber is controlled by the amount of said recirculated flue gas, or other low oxygen-containing gas or inert gas to be mixed with the oxygen-containing combustion gas.

23. The method as claimed in claim 18, wherein the act of maintaining a stoichiometric condition comprises keeping an essentially constant stoichiometric ratio in order to control the temperature.

24. The method as claimed in claim 19, wherein the stoichiometric ratio is kept within defined limits while the temperature in the combustion chamber is controlled by the amount of said recirculated flue gas, or other low oxygen-containing gas or inert gas to be mixed with the oxygen-containing combustion gas.

25. The method according to claim 7, where said solid fuel particles are crushed wood pellets having a diameter up to 4 mm.

* * * * *